US005240354A

United States Patent [19]

Quante

[11] Patent Number: 5,240,354

[45] Date of Patent: Aug. 31, 1993

[54] FLEXIBLE TELESCOPIC PROP FOR BUILDING MATERIALS

[75] Inventor: Heinrich Quante, Recklinghausen, Fed. Rep. of Germany

[73] Assignee: Ingenieurtechnik GmbH & Co. KG, Recklingshausen, Fed. Rep. of Germany

[21] Appl. No.: 773,615

[22] PCT Filed: May 10, 1990

[86] PCT No.: PCT/DE90/00330

§ 371 Date: Jan. 13, 1992

§ 102(e) Date: Jan. 13, 1992

[87] PCT Pub. No.: WO90/14499

PCT Pub. Date: Nov. 29, 1990

[30] Foreign Application Priority Data

May 16, 1989 [DE] Fed. Rep. of Germany ..... 3915837
Jan. 8, 1990 [DE] Fed. Rep. of Germany ..... 4000310

[51] Int. Cl.[5] ..... E21D 15/22

[52] U.S. Cl. ..... 405/290; 405/288; 405/303

[58] Field of Search ..... 405/288, 289, 290, 230, 405/229, 303

[56] References Cited

U.S. PATENT DOCUMENTS

| | | | |
|---|---|---|---|
| 3,396,545 | 8/1968 | Lamberton | 405/233 |
| 3,469,358 | 9/1969 | Archer et al. | 405/233 X |
| 3,891,184 | 6/1975 | Fields . | |
| 4,255,071 | 3/1981 | Koppers et al. | 405/290 |
| 4,332,512 | 6/1982 | Heintzmann et al. | 405/290 |

FOREIGN PATENT DOCUMENTS

| | | |
|---|---|---|
| 476783 | 5/1929 | Fed. Rep. of Germany . |
| 818332 | 10/1951 | Fed. Rep. of Germany . |
| 2847906 | 5/1979 | Fed. Rep. of Germany . |
| 3236421 | 5/1984 | Fed. Rep. of Germany . |
| 128580 | 1/1920 | United Kingdom . |
| 2100318 | 12/1982 | United Kingdom . |
| 2114183 | 8/1983 | United Kingdom . |

*Primary Examiner*—Dennis L. Taylor
*Attorney, Agent, or Firm*—James Creighton Wray

[57] ABSTRACT

The present invention relates to an adjustable support element for use in underground mining or tunnel construction, particularly for securing mining cavities at the longwall face and headway. The invention is a single use prop made of inner and outer telescopable tubes which can be filled with a hardenable building material core. The tubes have drainage boreholes for draining excess water from a liquid filling material pumped within the tubes after the prop has been braced between the roof and floor of the mines. Plural bands connected between the outer and inner tubes enable the telescopic movement of the tubes.

12 Claims, 5 Drawing Sheets

FLEXIBLE TELESCOPIC PROP FOR BUILDING MATERIALS

The invention relates to a support element for use in underground mining or tunnel construction, in particular for securing mining cavities at the longwall face and headway, comprising inner and outer tubes which move inside each other and a building material core which may be hardened and which keeps the two tubes at a distance from each other, whereby the outer and inner tubes are constructed as a telescopic tube which is continuous on the inside and is closed at the end.

BACKGROUND OF THE INVENTION

The so-called single use support is still used at the present time in many areas of underground mining. It consists primarily of suitably sized wood props, trough profile supports, double-T supports, etc. Often individual hydraulic props are also used, either to supplement the latter or by themselves. This results, however, in great expenditures because of the high production costs. The required support pressure in these hydraulic systems may be maintained advantageously by the pressure in the hydraulic system (300 to 600 bar) and accurately operating pressure limit valves. All props in the system are characterized by identical characteristic lines. Such hydraulic systems represent the optimum technical solution for rock support in a mobile version. But in a stationary version the above mentioned disadvantages occur. In headways where convergence is expected, so-called flexible trough profiles are used, whereby the friction coefficient is inaccurate and thus a safe and even support of the ceiling or the roof cannot be ensured. This also applies to the two-part roadway or headway props known from German Patent 818 332 where the outer prop is filled with a compressible fill mass. The intention there is to achieve a specific flexibility of the otherwise rigid construction. But the disadvantage is that such elements are not tight enough for effective fill masses to be used. The used bitumen-like plastic fill masses however do not provide the necessary and required support pressures. The same is true for the solution known from German Offenlegungsschrift 32 36 421.0 in which such a pasty mass is arranged between two hollow tubes and is supposed to be displaced from there.

The invention thus has the task of creating a support element used as a single use prop which supports early on, absorbs high pressures, and is easy to handle.

SUMMARY OF THE INVENTION

According to the invention this task is solved in that the prop is composed of two or more outer and inner tubes which form a telescopic pipe which is continuous on the inside and closed off at the end, said tubes being constructed so that they may be mechanically braced in various extension lengths, that they have drainage bore holes distributed over their length, and that the filling consists of a building material core which may be hardened.

With such a construction it is first possible to advantageously brace the telescopic tube between roof and floor using simple mechanics. From the start the invented single use prop is thus able to introduce significant forces into the rock as soon as the building material is filled in and has hardened. In addition, it is advantageously anchored stably so that the filling with concrete or building material may take place safely. Since the building material is only filled in later, the single use prop is easy to use and is characterized also in that the concrete or building material may be pumped in a more liquid form since the excess water is drained and removed over the drainage device, i.e. the drainage boreholes. Because of this draining, the filled in building material forms a supporting building material core which is significantly stabilized by the surrounding steel tube and is shaped so that it is able to absorb high supporting forces far in excess of 100 tons and pressure forces. Since the building material core in both tube parts stands after hardening as a support column, the mechanics providing the preload then are no longer significant, so that here a simple and cheap mechanism may be used. The invented telescopic prop has a preload of ca. 47 kg/N.

According to a useful version of the invention it is provided that several bands which run between inner and outer tube are both fastened at the top end of the outer tube and are also passed through openings at the bottom and around the bottom end of the inner tube and are attached at a collecting plate which is arranged in the inner tube, and that the collecting plate is at the same time connected via a center band with a spool rotating in and at the opposite inner tube end. In this manner the bands are able to fulfill their function without the threat of tearing in order to achieve the extension of the two outer and inner tubes.

So that the spool may also be used as a fill pipe, the invention provides that the spool is correlated with the crown cap-like-constructed head plate while being held by two U-sheets and is constructed as a hollow tube which is open on both sides and positioned inside the two U-sheets and a borehole in the inner tube and is equipped with either a flap valve which is located at the opposite end, i.e. the end ending in front of the inside wall of the inner tube, or a spring-loaded slide. Since the spool is located at the top end, i.e. in the area of the head plate, a complete filling of the telescopic tube with building material is secured in this manner, whereby the flap valve or slide ensure that after the filling the still fluid building material cannot drain.

In order to maintain the preload once it has been generated, the invention provides that in the area of the second U-sheet a return block is located, in the form of a rope wound several times around the spool and secured on both sides as well as a spring acting in the rope center. This return block functions according to the principle of rope friction. The rope which is wound several times around the spool in such a way that its ends are fastened and in whose rope center a spring is engaged generates the necessary friction forces which prevent a return of the spool once it is wound. The spool is turned with a winding bolt which engages with a tension bar which cuts through the spool.

According to the invention, other mechanisms for bracing the two tube parts which move inside each other consist of one in which the spool is constructed as a gypsy spool and set on the outside onto the top edge of the outer tube, and where on the outside wall of the inner tube, bands which correspond to the gypsy spool are arranged. The diameter tolerance between inner and outer tube is chosen so that at the inner tube two or three thin ropes or bands are fastened in such a way that the inner tube which is held in this way may still be moved inside the outer tube. The ropes here are also passed around the tabs at the lower end of the inner tube so that no destruction or damage can occur. The gypsy spool ensures a favorable winding moment and prevents unintentional unwinding.

According to another version the inner tube has strips with semi-threads on the outside longitudinal sheet metal; the spools are provided in the form of corresponding endless screws with hexagon sockets at the free end which are attached on the top edge of the outer tube; and the entire arrangement turns easily in this way, whereby the inner tube is "unscrewed" from the outer tube via the endless screws. It is also conceivable to assign separate bands to the outer and inner tube and to then move them relative to each other with the help of a tightening or closing apparatus as is commonly used in the packaging industry in such a way that it simultaneously pulls the inner tube from the outer tube. The necessary safeties are achieved particularly if the bands and the center band consist of plastic, e.g. a cord strap polyester.

In underground mining, two-component plastics for rock reinforcement are used. This material may also be used as a filler, whereby it is provided that in the absence of boreholes the filling is formed by a two-component plastic and is equipped with a reinforcement, preferably in the overlap area between outer and inner tube. The use of steel fibers or similar reinforcement results in a highly stable building material core so that such a single use prop is able to perform demanding supporting and securing tasks.

In order to produce an approximately identical characteristic line in all cases and to create a flexible support element, the invention provides that the filling comprises a deformation element which prevents transverse expansion, preferably in the form of a cartridge containing breeze concrete which has edges which may be moved inside each other. This deformation element or cartridge may be prefabricated in such a way that an accurate response resistance is provided. Limited insertion, in particular under unfavorable pressure conditions, ensures long standing times of such a single use prop. If the individual single use props always are correlated with the same deformation elements, the props advantageously have the same characteristic line. The use of a prefabricated cartridge ensures that the pressure, in $N/mm^2$, building up in the cartridge only allows compression when a predetermined response resistance has been overcome and a compression (measured in %) takes place, while a transverse expansion is impeded on all sides or is excluded.

Transverse expansions may advantageously be prevented in that the cartridge has two or more chambers of which one is filled with a pasty mass or grainy material and both are connected with each other and/or the atmosphere via a rupture disk or a valve, or in that one chamber is filled with non-hardening cement and the other chamber with steel balls or gravel. Here the displacement of the pasty material or pasty mass or overcoming of the resistance of the rupture disk or valve absorbs specific high forces before the desired flexibility is achieved.

High tensile forces may occur in particular if the prop does not slide from the predetermined position, something which is ensured in that the head plate is correlated with a building material-filled tissue cushion and is located fixed on the outside between the cams. Such a tissue cushion advantageously results in form fitting between the support elements which shall be connected. A kind of circular arch support is achieved in that the head plate and base plate are equipped with corresponding connecting butt straps with bolt boreholes and are connected with other elements resulting in a multi-segmented support arch. Because of the tissue cushions here additional forces may be absorbed, if the former are for example arranged in the joint areas.

The invention is characterized in particular in that a very versatile and, in particular, preloadable single use prop is created which is also easy to handle and easy to transport. This single use prop significantly increases support safety since it is installed according to the specific cases and is equipped with a building material core which absorbs high supporting forces. Hereby the building material is filled in through the inner tube with pressure after the two tubes have been pulled out or pushed apart via the tension device, which simultaneously ensures an even and complete filling. After the hardening of the building material core the sheathing is particularly advantageous, which is provided by those tube parts which are also suitable and designed in such a way that tensile forces may also be absorbed. A premature destruction of the outer and inner tubes which form a type of sheath is practically precluded, whereby the choice of quality of the respective tubes also may significantly increase the standing time of the tubes, especially also by the arrangement of the deformation elements which provide a limited flexibility.

Other details and advantages of the invented object result from the following description of corresponding drawings in which various preferred embodiments are shown with the necessary details and individual parts.

DETAILED DESCRIPTION OF THE DRAWINGS

Figure 1:
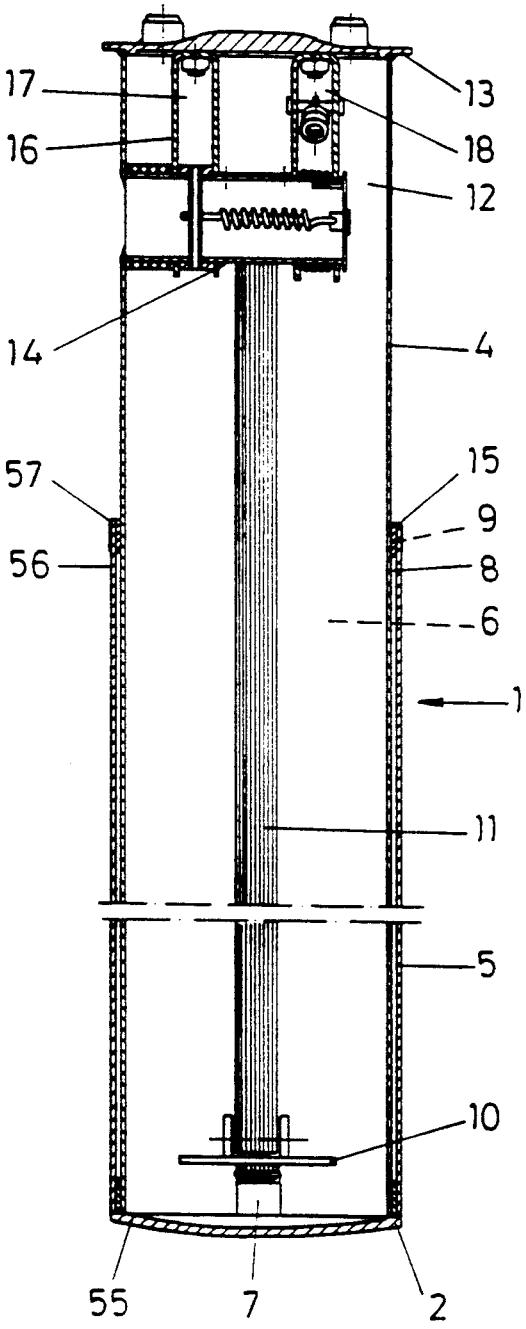
FIG. 1 shows a section of a single use prop.
Figure 4:
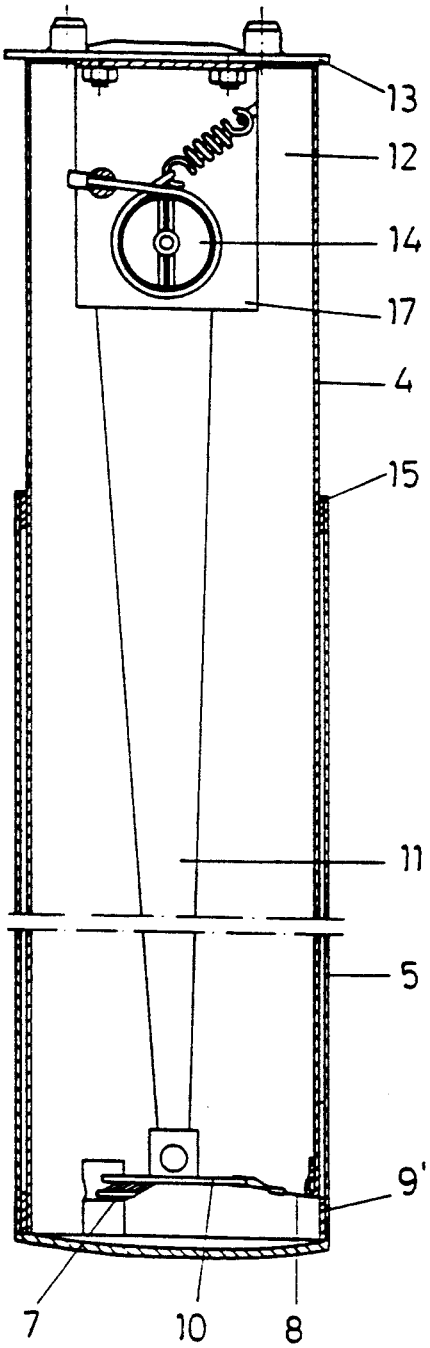
FIG. 4 shows the single use prop according to FIG. 1 in another longitudinal section.

In the drawing according to FIG. 1 the single use prop (2) consisting of the elements (1) is shown in the form of a stemple. The single use prop (2) here consists of two tube sections which are sized so that they may run inside each other. Accordingly, the inner tube (4) has a smaller diameter than the outer tube (5). After extension and bracing between the roof and floor, or topwall and footwall (not shown), the filling (6) shown in FIG. 1 in the form of a building material core is filled in and makes it possible for the single use prop (2) to absorb high pressure forces. Experiments have shown that a 4.4 m long prop with 300 mm diameter has a supporting strength of 395 tons. A 6 m long prop with the same diameter still has 255 tons support strength. A 4 m long prop with 200 mm diameter has 170 tons supporting strength. Since the inner tube (4) transcends into the outer tube (5) without a bottom, it is possible to fill both tubes simultaneously with the building material.

Figure 2:
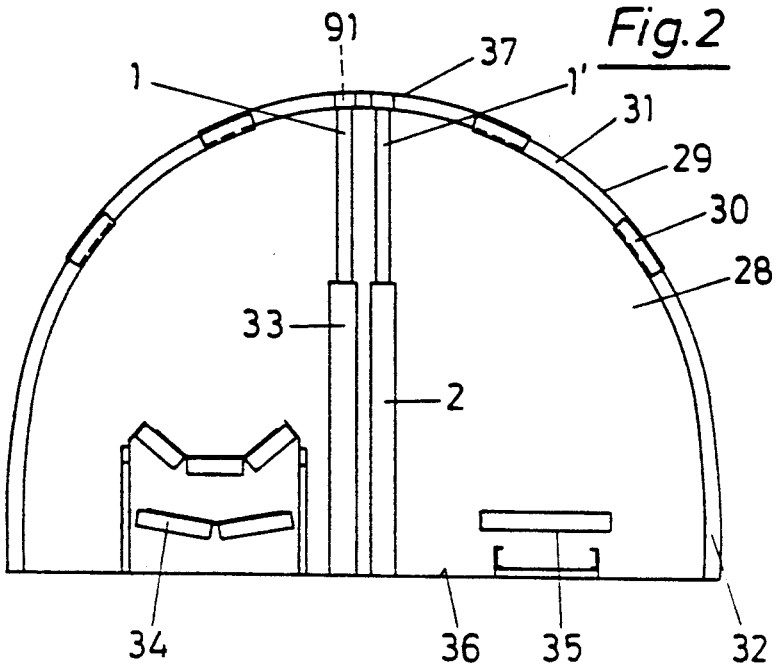
FIG. 2 shows a cross-section of a headway with single use support element.

In order to be able to brace the single use prop (2) between the roof and floor, i.e. to install it with a certain preload, bands (7,8) run between inner tube (4) and outer tube (5) and pass through openings (9) through the respective wall of the inner tube or outer tube. The openings are designated with (9 or 9') and have a special shape in as far as they form a tab by folding down a corresponding partial section. FIG. 2 shows this particularly clearly in the bottom area.

The bands (7,8) are fastened at the free end of the outer tube (5) and attached in the area of the lower end of the inner tube (4) at a collecting plate (10) which is located there. In the version shown in FIGS. 1 and 2, three bands (7,8) each are fastened to the collecting plate (10) by forming a loop. On the top of the collecting plate (10) a center band (11) which is attached at the opposite inner tube end (12) in the area of the head plate (13) at a spool (14) is deflected. This spool (14) is operated from the outside so that the winding up of the central band (11) changes the position of the collecting plate (10) which simultaneously pulls the inner tube (4) from the outer tube (5) and in this way a bracing of the steel pipe (1) is achieved. In the process it is important that the individual bands (7,8) are attached at the top edge (15) of the outer tube (5) in such a way that a shortening of the center band (11) also safely makes the inner tube (4) leave the outer tube (5). For this purpose a guide ring (57) at the open end of the outer tube (5) is provided.

The spool (14) is safely positioned via a mounting (16) which is connected with the head plate (13). The mounting (16) consists of two U-sheets (17,18) which are arranged at an interval, so that the spool (14) is supported at a total of four points and thus may be rotated from the outside in the steel pipe (1) without problems.

FIG. 2 shows an application case for the single use prop. Here a headway (28) is shown which is secured by support arches (29). These support arches (29) consist of various segments (31,32) which are held together via connections (30), whereby these move into each other when the friction forces produced by the connection (30) are exceeded, so that the cross-section of the headway (28) secured by the support element correspondingly decreases. In order to delay this moving-in as long as possible, the single use prop (2,33) is inserted between floor (36) and roof (37) in such a way that it is able to absorb corresponding supporting forces. This ensures that the cross-section necessary for conveyors (34) and trolley (35) is maintained conceivably for a long time.

In the area of the head plate (13) the inner tube (4) has a bore (65) (FIG. 5) through which the building material may be filled into the entire element (1). This borehole is closed by a flap valve (67) in order to prevent the filled-in building material from flowing back after the filling process.

Figure 3:
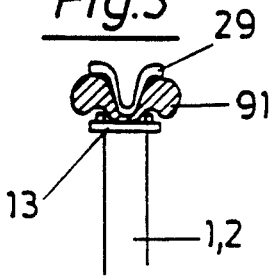
FIG. 3 shows an enlarged drawing of the connection area between supporting arch and telescopic prop.
Figure 5:
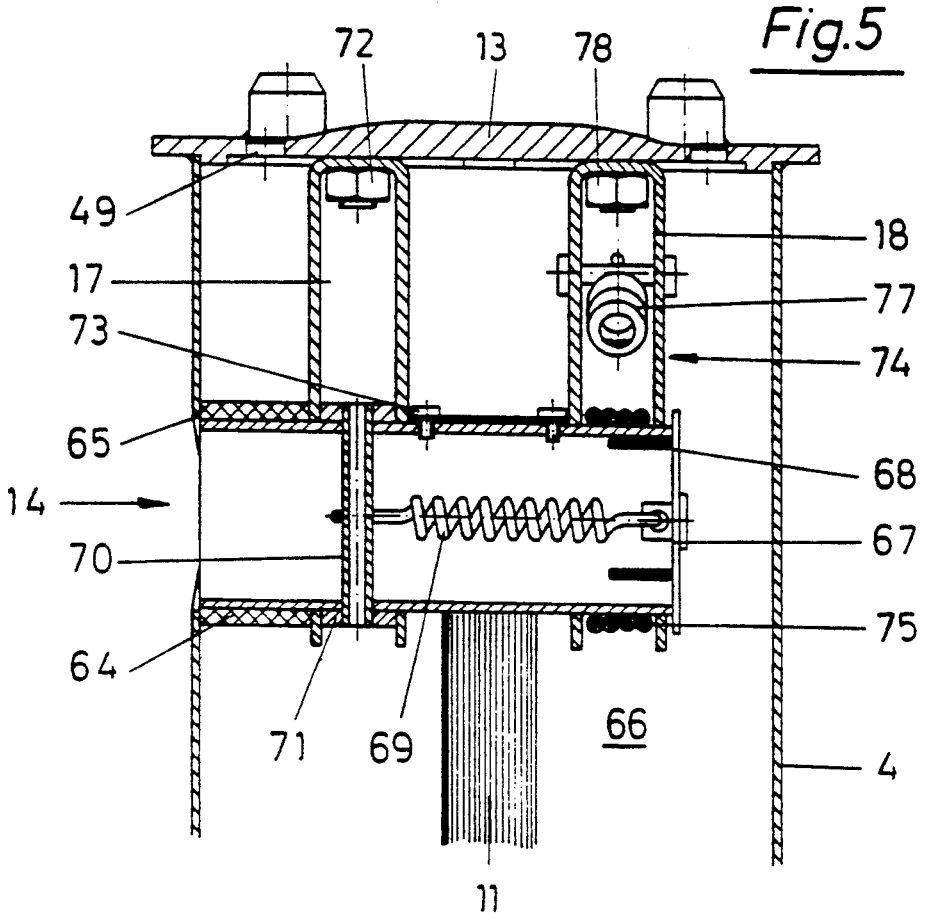
FIG. 5 shows an enlargement of the head area of the single use prop with a longitudinal section of the spool.
Figure 6:
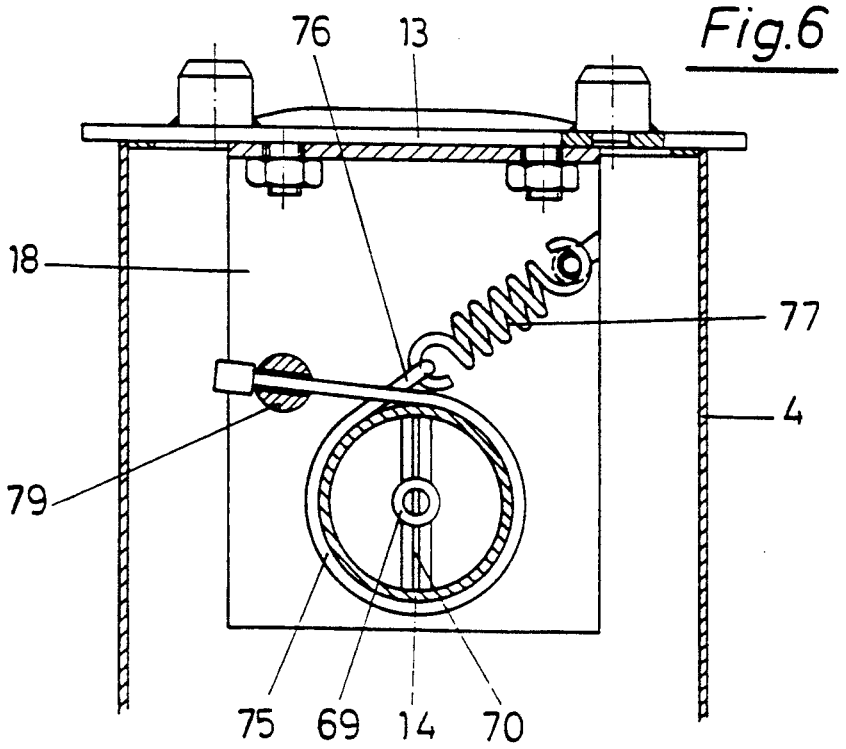
FIG. 6 shows a cross-section of the head area of the single use prop with spool.

FIG. 3 shows the top end area of a prop which is used for supporting the top segment of the support arch (29) according to FIG. 2. Between this support arch (29) and the head plate (13) a tissue cushion (91) has been arranged which closely surrounds the support arch (29) and head plate (13) after the building material contained in the tissue cushion (91) hardens, so that a form-fitting connection is achieved. FIG. 5 and 6 show the top area of the single use support element (2). The enlarged drawing details the simple and useful support of the spool (14) and its safeguarding against unintentional return during the filling in of the building material (6). The seal (64) is located in the front area of the spool (14). Its exact position is defined both by the wall of the inner tube (4) and the U-shaped sheet (17). This sheet (17) thus ensures safe positioning of the seal (64) which effectively seals the area around the borehole (65). The U-sheet (17) also ensures an overall thrust-resistant position of the spool (14) by holding between the two walls of the U-sheet (17) an external ring (71) which has a tension bar (70) which simultaneously functions as support for the recuperator spring (69) of the flap valve (67). The flap valve (67) which is equipped with an inside guide (68) securely closes the internal chamber (66) of the inner tube (4) and outer tube (5) towards the spool (14) which is otherwise open on both ends. The filling in of the building material then moves the flap valve (67) in such a way that the building material is able to flow into the internal chamber (66). When the building material stream slows down the flap valve (67) automatically recloses.

The U-sheet (17) is connected to the head plate (13) via the screw (72), in the same manner as the U-sheet (18) is connected via screw (78) to the head plate (13). (73) are attachment screws with which the central band (11) is fastened to the spool (14).

A simple brake for the spool (14) is provided via the return block (74) consisting of a rope wound several times around the spool (14) which is fastened at the end via a rope fastener (79). The rope loop (76) holds a spring (77) which ensures that the rope (75) with its various turns always lies tight to the spool (14). The function and attachment are shown especially clearly in FIG. 6, whereby the rope fastener (79) grabs both sides of the rope (75).

FIG. 6 also shows that above the spool (14) a fill pipe which is charged particularly advantageously is provided. Corresponding with this type of fill pipe a winding bolt has been provided which may be inserted into the spool (14) and which is fastened to the tension bar (70) via angled and transverse slits corresponding with it.

Figure 7:
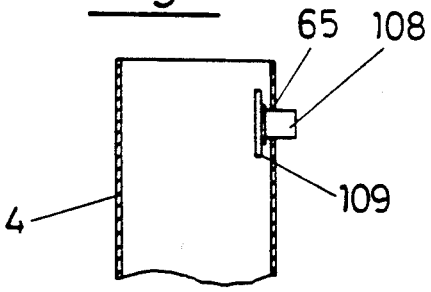
FIG. 7 shows a simplified drawing of a filling pipe installed in the inner tube.

FIG. 7 shows another version of the fill pipe (108) which is in this case secured with a slide (109) which again is loaded by a spring (111) in such a way that it again automatically closes the borehole (65) in the inner tube (4) after withdrawal of the filling hose.

Figure 8:
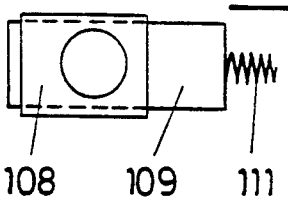
FIG. 8 shows a top view of the slide correlated with the filling pipe.

FIG. 8 shows the deformation element (95) located in the lower area of the outer tube (5) and already indicated in FIG. 1, i.e. in the form of a prefabricated cartridge (96). As a supplement to this, FIGS. 9 and 10 should be referred to, whereby FIG. 10 shows a version where a specific breeze concrete (97) is located inside the cartridge (96) which impedes the pushing together of the parts of the cartridge (96) which has interfitting edges (98,99). With the deformation of the breeze concrete (97) the single use prop (2) may be moved in as far as inner and outer tube (4,5) move inside each other, i.e. as far as the breeze concrete permits.

Figure 9:
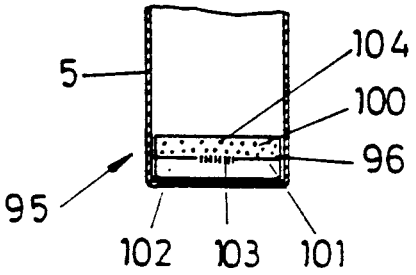
FIG. 9 shows a dual-chambered construction of the deformation element.
Figure 10:
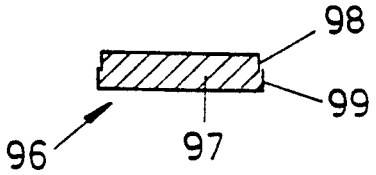
FIG. 10 shows an insertable construction of the deformation element.

According to FIG. 9, a cartridge (96) with two chambers (100,101) is provided which is integrated into the single use prop (2), whereby the bottom chamber (101) is filled with a pasty mass (102). Both chambers (100,101) are separated by a rupture disk (103) which ensures that the deformation element (9) is not unintentionally compressed. The upper chamber (100) is filled with gravel (104) into which the pasty mass (102) must be pressed during the crushing of the rupture disk (103). The pressing of the pasty mass (102) into the chamber (100) and thus into the gravel (104) compresses the deformation element (95) and the single use prop (2) becomes flexible.

Figure 11:
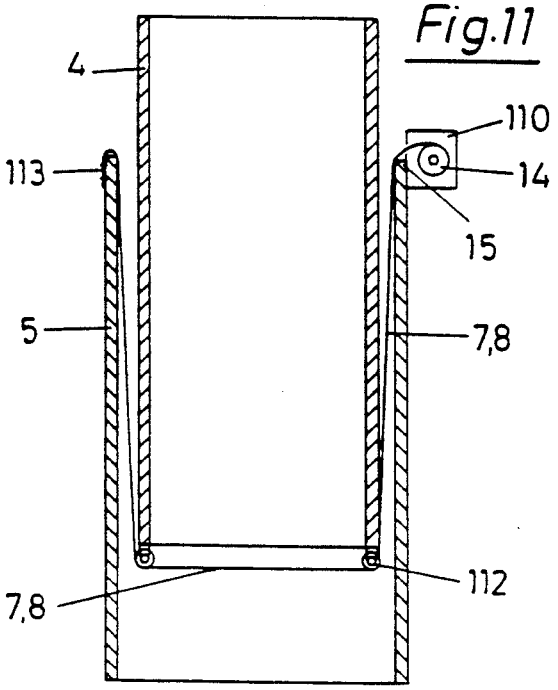
FIG. 11 shows a section through the telescopic prop with automatic bracing.

FIG. 11 shows the already described version in which a corresponding band (7,8) is fastened on one side at the fixing point (113) and is then passed on the bottom around the bottom end and the deflection rolls (112) located there again upward towards the edge (15) where a spool (14) is positioned in a case (110). The winding up of the band (7,8) causes this spool (14) to lift or extend the inner tube (4) from the outer tube (5).

Figure 12:
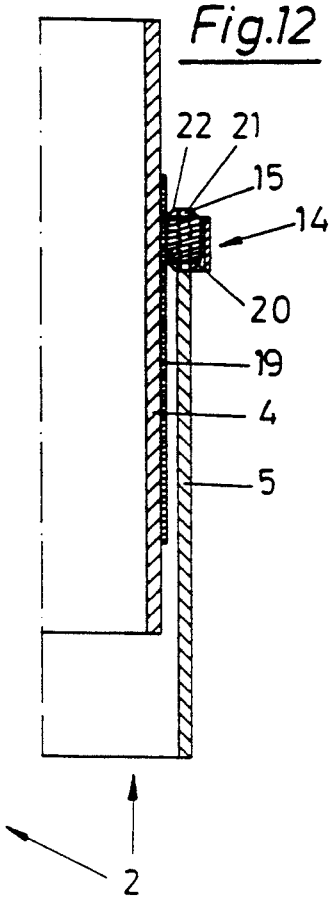
FIG. 12 shows another construction of the single use prop.

FIG. 12 shows a version in which the spool (14) is also set onto the top edge (15) of the outer tube (5). However, the spool (14) here consists of an endless screw (20) which engages with a sheet metal strip (19) set onto the outside wall of the inner tube (4). The endless screw (20) has a hexagon socket (21) at its free end (22) so that it turns easily. The sheet metal strip (19) is equipped with a semi-thread as it is found in adjustable hose clamps. The top edge (15) of the outer tube (5) supports the endless screw (20) which is equipped with the hexagon socket (21), whereby the mounting (16) is provided in the form of a simple push-over cap.

Figure 13:
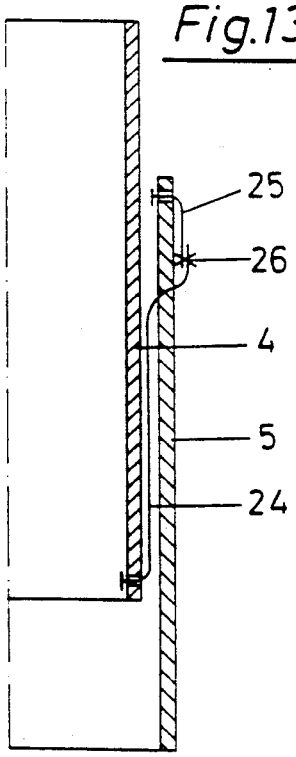
FIG. 13 shows an automatic bracing of the outer and inner tube which is taken from the packaging industry.

Another version is shown in FIG. 13, where ropes and bands are distributed around the circumference. These steel bands (24) in this version are fixated at the lower end of the inner tube (4), are passed e.g. via the attachment plate and then the intermediate space between inner tube (4) and outer tube (5) and are again returned to the outside at the top end of the outer tube (5). In addition, a band end section (25) is also fastened to the top end of the outer tube (5) in the form of a steel band, so that with the help of a commercially available tightening and closing apparatus the two bands are simply moved relative to one another in order to extend the telescope. In the end position the safety (26) takes care of fixation. Corresponding apparatuses and the connection of the steel bands (24,25) are known e.g. from the packaging industry.

Figure 14:
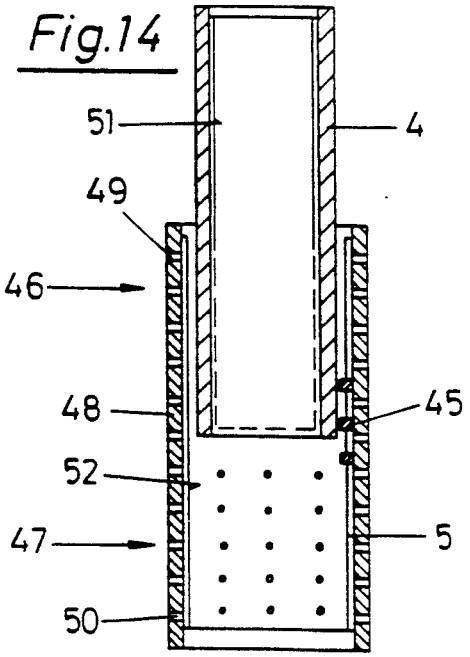
FIG. 14 shows a section of a single use prop with drainage boreholes and reinforcement.
Figure 15:
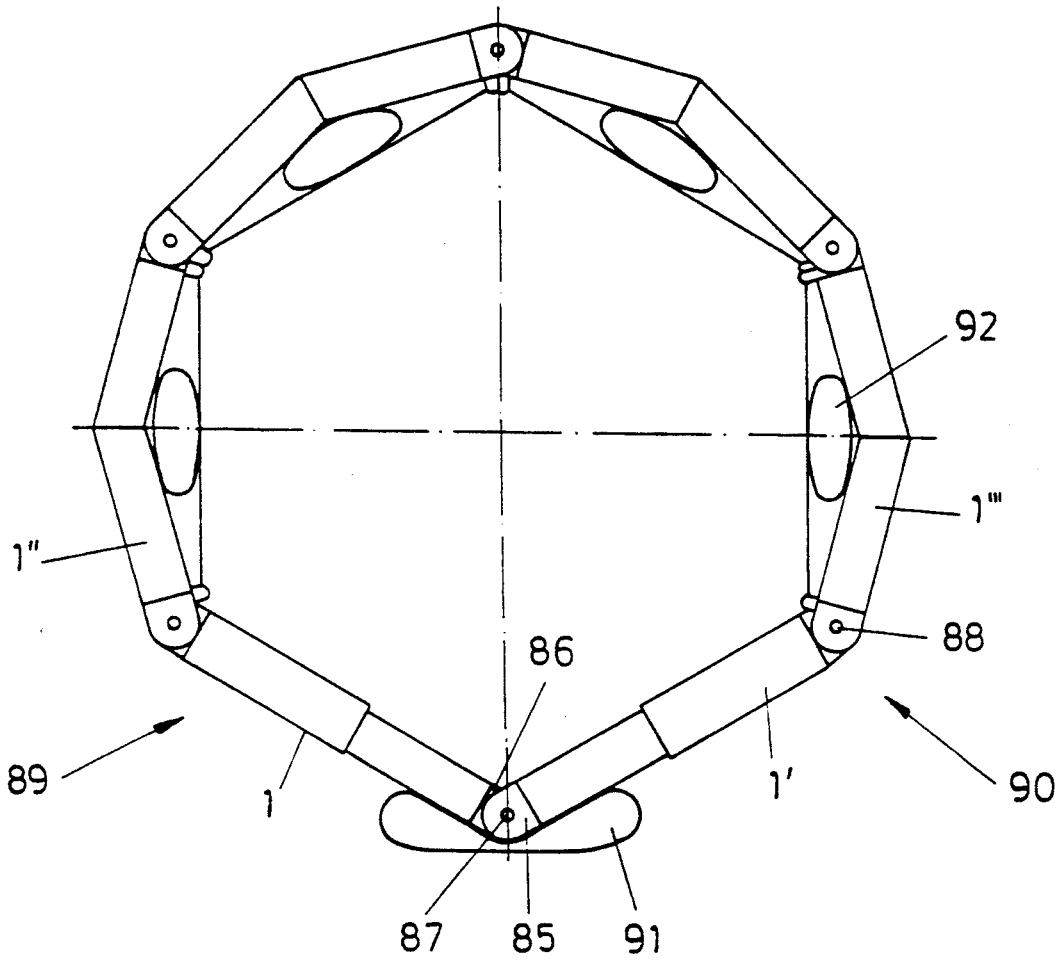
FIG. 15 shows a single use prop consisting of several support elements interconnected with joints.

FIG. 14 clarifies how the moisture in the filled in building material core (6), i.e. the respective filling, may be drained quickly and evenly. The corresponding drainage elements (47) which are arranged evenly over the length of the inner tube (4) and outer tube (5) consist of drainage boreholes (49,50) in the wall (48) which are covered with a filter cloth (51 or 52) covering the inside of the inner tube (4) or outer tube (5). While water may drain unhindered, the building material is held back effectively so that a stable building material core (6) forms inside the tubes. In the transition area (46) a reinforcement (45) is located which may also be located in the other areas in order to stabilize the building material core (6).

It has already been explained above that by connecting the various steel pipes (1, 1', 1'', 1''') a support arch (89) may be produced from the single use prop (2), whereby the individual steel tubes or props have on their respective ends connecting butt straps (85,86) with bolt boreholes (88) and bolts (87). This facilitates installation and enables a bracing in that some of these props consist as described of telescopic tubes and some only of simple tubes. In the area of the bending points or connections tissue cushions (92) may be arranged which are filled with building material. This results overall in an arch shape resembling a circular arch support.

I claim:

1. A support element for use in underground mining and tunnel construction, particularly to secure mining cavities at a longwall face and headway, comprising an outer tube and an inner tube telescopically movable within the outer tube, a guide ring between the tubes on an open end of the outer tube to keep the tubes spaced from each other, wherein the tubes form a prop, the prop being continuous on the inside and being closed off at one end, said tubes having means for mechanically bracing the tubes at plural extension lengths, plural drainage boreholes distributed over a length of each of the tubes and a filling consisting of a hardenable building material.

2. The support element of claim 1, further comprising plural bands running between the outer and the inner tube, the bands being fastened at a top end of the outer tube and being passed through plural openings at a bottom end of the inner tube and the bands being attached to a collecting plate within the inner tube, and further a center band being connected at one end to the collecting plate and at another end to a rotatable spool placed at an upper end of the inner tube.

3. The support element of claim 2, further comprising first and second U-sheets attached to a crown cap-like head plate for movably receiving the spool, said spool being in the form of an open sided hollow tube, further comprising movable means at the upper end of the inner tube for shutting the upper end of the telescopable tubes after filling the tubes with the building material.

4. The support element of claim 3, further comprising a return block placed by the second U-sheet, said block comprising a rope wound several times around the spool, a center of the rope being attached to a spring means and each of a first and second ends of the rope being attached to a fastening means.

5. The support element of claim 2, wherein the spool is a gypsy spool and is set on an outer side of a top edge of the outer tube and corresponding plural bands are placed on an outer side of the inner tube associated therewith.

6. The support element of claim 2, further comprising plural longitudinal sheet metal strips being attached to an outer side of the inner tube, the strips being semi-threaded for associating with the spool provided as endless screw means with a hexagon socket at a free end of the screw means, said screw means being attached to a top edge of the outer tube.

7. The support element of claim 2, wherein the plural bands and the center band comprise of plastic materials as a cord strap polyester.

8. The support element of claim 1, wherein the filling comprises a dual component plastic equipped with a reinforcement in a transition area between the outer and the inner tubes.

9. The support element of claim 1, wherein the filling comprises a deformation element to prevent transverse expansion, the element being in the form of a cartridge containing breeze concrete having edges movable relative to each other.

10. The support element of claim 9, wherein the cartridge has at least two interconnected chambers, one chamber for filling with a pasty mass or grainy material and the other chamber for filling with steel balls or gravel, a connection between the two chambers and the atmosphere being effected by a rupture disk.

11. The support element of claim 3, wherein further a tissue cushion is fixed on an outer side of the head plate.

12. The support element of claim 1, further comprising plural headplates and plural footplates comprising corresponding plural butt straps each having plural bolt boreholes connected to each other by plural connection means to form a multi-segmented support arch.

* * * * *